US007131411B1

(12) United States Patent
Rhoads et al.

(10) Patent No.: US 7,131,411 B1
(45) Date of Patent: Nov. 7, 2006

(54) ADJUSTABLE FAST BLEED LIFTER

(76) Inventors: Jack L. Rhoads, 10590 N. Thunder Hill Pl., Tucson, AZ (US) 85737; Justin D. Rhoads, 1497 W. Canyon Shadows, Tucson, AZ (US) 85737

( * ) Notice: Subject to any disclaimer, the term of this patent is extended or adjusted under 35 U.S.C. 154(b) by 0 days.

(21) Appl. No.: 11/074,117

(22) Filed: Mar. 7, 2005

(51) Int. Cl.
*F01L 1/14* (2006.01)

(52) U.S. Cl. ..... 123/90.57; 123/90.48; 123/90.55

(58) Field of Classification Search ..... 123/90.55, 123/90.57, 90.33, 90.48, 90.52
See application file for complete search history.

(56) References Cited

U.S. PATENT DOCUMENTS 2,941,523 A * 6/1960 Bergmann ..... 123/90.55
3,921,609 A 11/1975 Rhoads
4,133,332 A * 1/1979 Benson et al. ..... 123/198 F
4,228,771 A * 10/1980 Krieg ..... 123/90.55
4,524,731 A 6/1985 Rhoads
4,913,106 A 4/1990 Rhoads
4,977,867 A * 12/1990 Rhoads ..... 123/90.49

OTHER PUBLICATIONS

Unaware of any Non Patent Literature Documents.

* cited by examiner

*Primary Examiner*—Thomas Denion
*Assistant Examiner*—Zelalem Eshete

(57) ABSTRACT

A limited leak-down variable duration lifter and its adjustment is provided to maximize performance gains at low engine rpm when used with a conventional cam and more particularly with a conventional hi-performance camshaft. The increased performance gains were here-to-for unobtainable with conventional variable duration lifters and the conventional adjustment. By utilizing an adjustable valve train to precisely position the plunger of an accelerated leak variable duration lifter near the bottom of its travel, optimum reductions of lift and duration are achieved without exceeding amounts that would be detrimental to the engine and its valve train. To maintain proper rocker arm geometry, the plunger is positioned closer to its seat in the assembled state by either reengineering the internal dimensions of the lifter, or by providing a spacer or spacers between the plunger and the push rod cup, or plunger and seat.

7 Claims, 2 Drawing Sheets

ADJUSTABLE FAST BLEED LIFTER

BACKGROUND OF THE INVENTION

1. Field of Invention

This invention relates to hydraulic valve lifters, and more specifically to variable duration hydraulic valve lifters, also know as fast bleed lifters.

2. Prior Art

Conventional hydraulic valve lifters have the benefit of adjusting the valve train, if necessary, every time the valve seats. They are designed with very little bleed down as compared with variable duration lifters. In fact, most hydraulic lifters are designed with as little bleed down as possible.

Variable duration hydraulic valve lifters, on the other hand, have a deliberately faster bleed down rate so as to improve the low end performance of the engine. They are an improvement upon the basic hydraulic lifter for increasing low end torque, engine vacuum and other low end performance characteristics of high performance engines. The performance cam of the high performance engine causes valve overlap, which is effective at improving performance at high speeds, but reduces low-end torque, engine vacuum, fuel economy, increases exhaust emissions and produces a rougher idle. The variable duration, or "fast bleed" lifter helps to improve this problem. The bleed down rate of a variable duration lifter is carefully set so that the plunger leaks down more at low rpm than it does at higher rpm. This begins to restore the lift and duration as the rpm increases; hence the term "variable duration".

Jack L. Rhoads has three prior patents on bleed-down lifters, the first of which is U.S. Pat. No. 3,921,609, issued on Nov. 25, 1975. The second is a modification and improvement on the first and bears U.S. Pat. No. 4,524,731, issued Jun. 25, 1985. Thorough descriptions of the purpose and functioning of bleed-down lifters are found in those patents. Since variable duration lifters cause the valve train to tick at idle, a third U.S. Pat. No. 4,913,106, designed to quiet the valve train, was issued on Apr. 3, 1990. This patent requires the use of a specially modified camshaft. Our invention applies to these lifters, as well as any other fast bleed lifter such as the "sloppy fit" lifter in which the bleed bypass consists of a loosely fit plunger. It also applies to all the different designs of hydraulic lifters such as flat tappet, roller lifters, lash adjusters, hydraulic buckets, etc.

None of the above patents, however, produce the performance increases for conventional cams that this invention does. They either do not have the precise bleed down control necessary, or as in U.S. Pat. No. 4,913,106, the design is for a completely different purpose of quieting the valve train by utilizing a modified cam with special closing ramps. A conventional cam is a cam that is designed for use with conventional lifters, either hydraulic or solid lifters, and is not specifically designed to be used exclusively with fast bleed down lifters referred to in U.S. Pat. No. 4,913,106.

The former patents control the amount of bleed down by the size of groove machined into the side of the plunger, and other bleed down lifters such as the "sloppy fit" control bleed down by the dimensional clearances between plunger and the outer lifter body. They are adjusted from the top down, leaving ample travel between the plunger and lifter seat for excessive bleed down if the bleed rate is too high. This makes precise bleed down impossible as valve spring pressure, oil pressure, oil viscosity and engine temperature all work together to alter the total bleed down. A bleed rate that is ideal for one engine may be too much for another. As a result, the bleed rate must be made less than optimum because of the concern that too much bleed down will cause undue stress to the valve train which could cause valve train damage. The latter patent has provision for controlling the bleed down, but its purpose is to quiet the valve train by utilizing a modified cam with special closing ramps. It was not intended to be used with conventional cams at all, and virtually all cams currently available are of the conventional design.

This invention combines the precision bleed down control of the latter patent, with the conventional high performance cams used with the former two patents. As a result of this combination, performance gains have been significantly improved with camshafts that are readily available to the public, without excessive stress to the valve train. By limiting the bleed down of the variable duration lifters as described in this invention, maximum reductions in lift and duration can be realized without fear of bleeding too much and damaging the valve train. This has many advantages over the prior art.

BACKGROUND OF THE INVENTION—OBJECTS AND ADVANTAGES

Accordingly several objects and advantages of our invention are as follows:

First, the more the bleed down, the more the lift and duration are reduced, and the more the low-end torque and vacuum are increased. Engine idle, exhaust emissions and potential for better gas mileage are also improved with more plunger bleed down. It is therefore advantageous to have as much bleed down as the engine's valve train will allow. This invention allows for the maximum bleed down without encountering valve train damage. Also, since the bleed down amount is controlled in the adjustment, a faster bleed lifter can be used without increasing the bleed down travel of the plunger. No provision is made for this in two of the aforementioned patents. The increased bleed rate significantly improves the high rpm potential of an engine utilizing this improvement. It also raises the point at which the lifters become effectively solid on the rpm scale. This can increase the power at higher rpm levels with engines using larger cams. Secondly, since our invention utilizes conventional camshafts rather than specially modified cams used in U.S. Pat. No. 4,913,106, the customer has many more performance cams to choose from when using our invention. They do not need to purchase a special cam to take full advantage of the performance benefits herein described.

Another major advantage of this invention is that the performance enthusiast can vary the amount of adjustment to suit a particular need. For instance, adjusting the lifters for a reduced bleed down will tend to favor top end power, while more bleed down will help low end performance. Some enthusiasts prefer the lopey idle sound that a high performance cam produces. By adjusting the exhaust valve with less bleed down than the intake, a lopier idle will be the result. In other instances such as in turbo charged engines, the exhaust can be adjusted for more bleed down while the intake valve is adjusted with less. This will help reduce fresh intake gases from escaping through the exhaust valve during the overlap phase.

Currently a number of race car drivers are utilizing this invention to qualify on tracks that have engine vacuum rules. For instance, some race tracks will require that an engine have 17 inches of vacuum. If their engine is only producing 13 inches, this invention will almost certainly increase their vacuum to 17 inches, whereas the standard variable duration lifter of the prior art may only increase the vacuum by 2 inches, which would not be sufficient to qualify.

For example, a recent product test performed for Hot Rod Magazine which will be published in the June or July '05 issue, tested our invention on a roller cam engine with standard lifters and a conventional high performance camshaft. The engine only produced 10 inches of vacuum with the standard lifters. After the installation of the variable duration lifters in accordance with this invention, the engine produced 15 inches of vacuum and idled much better than before, and the low end torque increased a very impressive 33 foot pounds at 2200 rpm, from 307 to 340. These performance gains could not have been achieved with standard variable duration lifters and the standard top down adjustment.

If minor reductions in lift and duration are called for as when using variable duration lifters on stock or mild performance cams, a variable duration lifter with a slower bleed down rate can be used to restore lift and duration sooner in the rpm range. In such applications, the plunger may or may not bottom out against its seat, but the plunger travel limitations are still useful to limit the amount of plunger travel beyond which the bleed down should not exceed.

Further objects and advantages of our invention will become apparent from the consideration of the drawings and ensuing description.

SUMMARY

This invention is aimed at maximizing the performance of an engine equipped with a conventional camshaft and variable duration hydraulic lifters, also know as "fast bleed" lifters, hereinafter referred to as lifters. This is accomplished by limiting the bleed down of the lifter's plunger so that optimum reductions in duration and lift are achieved.

This limitation is accomplished by positioning the plunger very near the bottom of its travel, defining the maximum distance the lifter can bleed. Depending on the bleed rate of the variable duration lifter and the adjustment of the connecting linkage, the plunger may or may not bottom out against its seat.

To improve rocker arm geometry without the need for custom length pushrods and/or to simplify the adjustment, the lifters internals are so dimensioned as to position the plunger closer to its seat when the lifter is in its assembled state. This is also accomplished through the use of internal spacers either above or below the plunger.

DRAWINGS—FIGURES

DRAWINGS—REFERENCE NUMBERS

| | |
|---|---|
| 10 | variable duration hydraulic lifter |
| 12 | outer cylindrical body |
| 14 | plunger |
| 16 | lifter seat |
| 18 | push rod cup |
| 20 | retaining clip |
| 22 | spacer |
| 24 | oil chamber |
| 26 | push rod |
| 28 | conventional cam |
| 30 | base circle of cam |

DETAILED DESCRIPTION—FIGS. 1 THRU 5—PREFERRED EMBODIMENT

Figure 1:
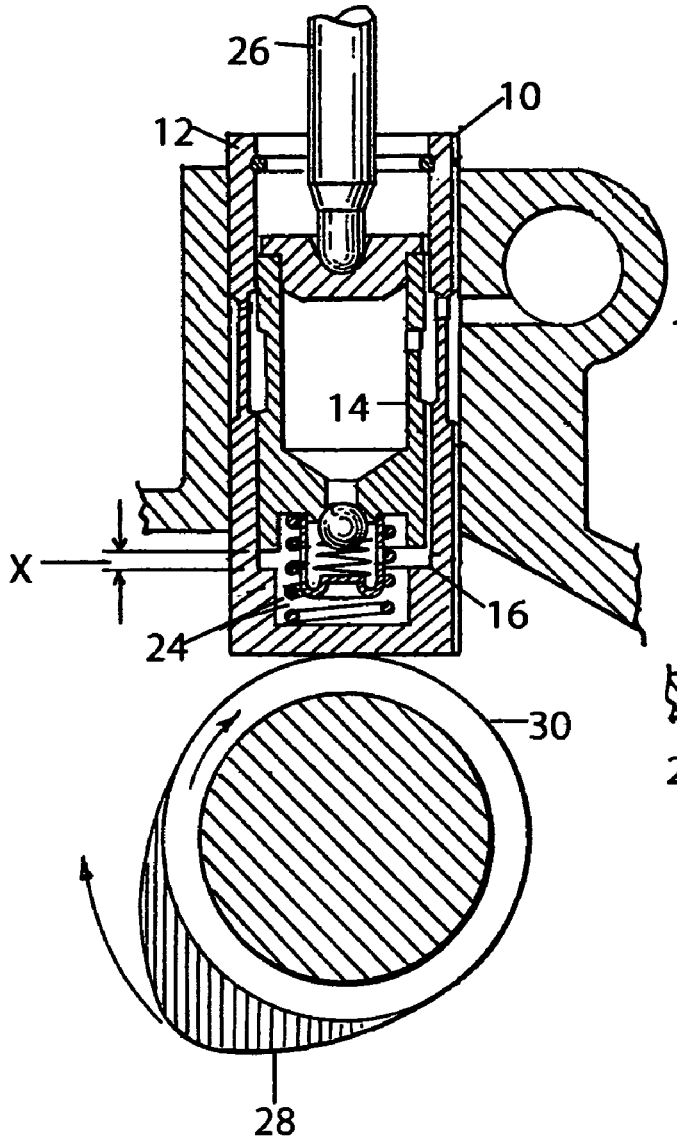
FIG. 1 illustrates the plunger of our invention cut away in the position in which the valve is statically seated.

FIG. 1 shows a cut away of the preferred embodiment of the positioning of the plunger 14 by the pushrod 26 in relation to the lifter seat 16. The seat is defined by the outer cylindrical body 12 of a variable duration hydraulic lifter 10. The lifter rides upon the base circle 30 of a conventional camshaft 28 while the valve is statically seated. The X is the distance from said plunger to said seat, which defines an oil chamber 24 there-between and generally is set between 0.010 and 0.030 inch.

Figure 2:
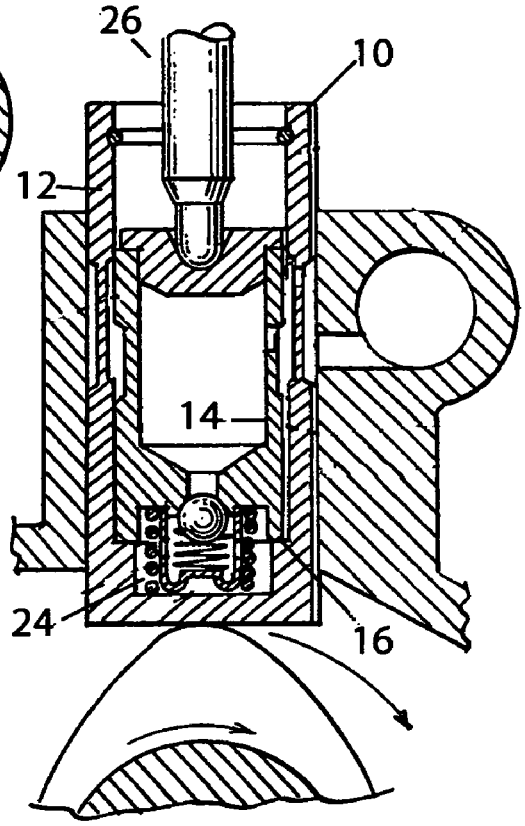
FIG. 2 is identical with FIG. 1 but illustrates a later point in the lift cycle in which the plunger has bottomed out.

FIG. 2 is identical to FIG. 1 but shows the plunger 14 bottomed out against said lifter seat 16 at a later point in the lift cycle.

Figure 3:
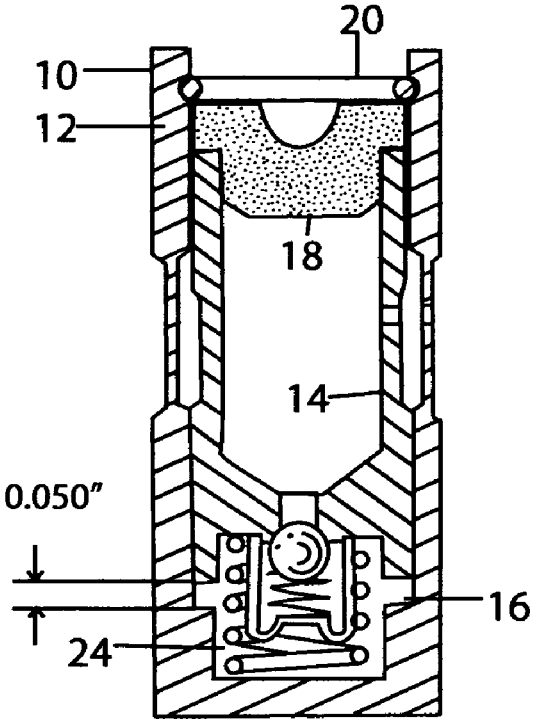
FIG. 3 illustrates a cut away showing the internals of a variable duration lifter in its assembled state with the plunger positioned to within 0.050 inch above its seat.

FIG. 3 shows the lifter 10 with its internal dimensions modified such that the plunger 14 is positioned above its seat 16 on the order of 0.050 inch when the lifter in its assembled state as the pushrod cup 18 contacts the retaining ring 20.

Figure 4:
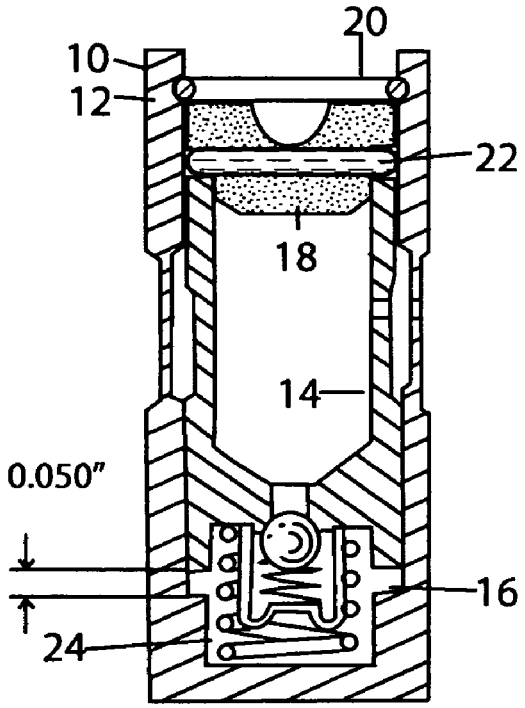
FIG. 4 illustrates a cut away showing the internals of a variable duration lifter in its assembled state with a spacer between the plunger and pushrod cup which positions the plunger to within 0.050 inch from its seat.

FIG. 4 shows the same lifter as in FIG. 1, except that a spacer 22 is provided and is positioned between said plunger and the pushrod cup 18, so that said plunger is positioned on the order of 0.050 inch above its seat when the lifter is in its assembled state as the pushrod cup 18 contacts the retaining ring 20.

Figure 5:
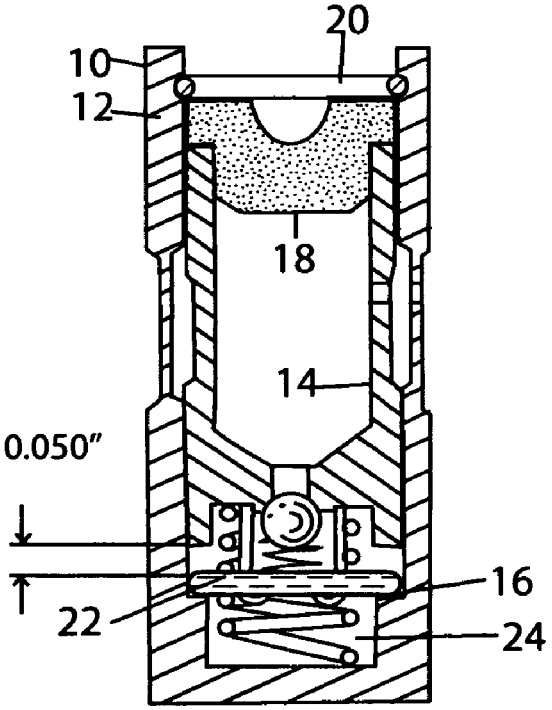
FIG. 5 illustrates a cut away showing the internals of a variable duration lifter in its assembled state with a spacer between the lifter seat and plunger which positions the plunger to within 0.050 inch from the spacer.

FIG. 5 shows the same lifter as in FIG. 1, except that a spacer 22 is provided and is positioned between the lifter seat 16 and the plunger 14 so that said plunger is positioned to within 0.050 inch above the spacer with the lifter in its assembled state as the push rod cup 18 contacts the retaining ring 20.

Operation—FIGS. 1 thru 5

The full details of the construction of the valve and the valve train, as well as the function and design of variable duration hydraulic lifters are covered in the above-referenced issued patents and will not, in its entirety, be detailed again here. The variable duration lifter referred to in this invention applies to all types and designs of variable duration or fast bleed lifters, regardless of what name they are given.

The improvement outlined in this invention deals primarily with how the variable duration lifter is adjusted when combined with a conventional camshaft 28, that is, where the plunger in the lifter is positioned in relationship to the lifter's seat. The seat 16 defines the lowest position that the plunger 14 can travel. Once the plunger comes into contact with the seat 16, FIG. 2, no further bleed down can take place, eliminating any further reduction in lift and duration.

If a variable duration lifter bleeds too much, valve train damage can result. The more the duration and lift are reduced, the faster the valve hits the valve seat. There is an optimum amount of bleed down that yields the best performance without damage to the valve train. This requires the method used in this invention of positioning the plunger 14 a precise distance from its seat 16 to limit the bleed down of the plunger to the amount adjusted into the valve train.

There are a number of ways to position the plunger 14 a precise amount from its seat 16 with a variable duration lifter. The most popular way for a small bock Chevy is as follows: Make sure the lifter being adjusted is on the low side, base circle 30 of the cam when adjusting. Place a 0.030 inch feeler gauge between the valve stem and rocker arm and tighten the lock nut until the plunger bottoms out on the outer lifter body 12 and the valve begins to open. Then back off on the lock nut until the valve just closes and the pressure just releases off the feeler gauge. The exact distance X may vary from engine to engine, and may be determined through various kinds of testing such as dynamometer testing, street driven testing, etc. Currently the adjustment is being set between 0.010 to 0.030 inch with good results.

In conventional variable duration lifters, the proper adjustment of the plunger 14 is from the top of the retaining ring downward approximately 0.060 inch, placing it nearly 0.100 from its seat 16. Since the maximum amount of bleed down should generally not exceed 0.030 inch, the bleed rate must be made less than optimum because of the concern of bleeding too much and overstressing the valve train. This is the way variable duration lifters are currently adjusted on conventional camshafts. In conventional variable duration lifters, the amount of bleed down is controlled by the amount of bleed rate, or how fast the lifters leak down. Only in U.S. Pat. No. 4,913,106 was the adjustment made from the bottom up, but this was for the completely different purpose of quieting the valve train when used with a specially modified camshaft. It wasn't until recently that we discovered that major improvements in performance could be realized with our new discovery of combining bottom up adjustment with conventional camshafts.

In addition to the method described above, precision length push rods 26 can be used on non-adjustable valve train engines to drive the plunger to within the proper distance. In most instances, however, an adjustable valve train will be utilized to accomplish the precise setting. This invention is not limited to any particular method of setting the adjustment.

Since hydraulic lifters were not designed to be adjusted from the bottom up, to do so almost always creates a rocker arm geometry problem. Driving the plunger nearly to the bottom of the lifter causes the rocker arm to tilt back an amount that is not consistent with proper rocker arm geometry. This can reduce performance and possibly cause damage to the valve train. To counter this problem, FIGS. 3 thru 5 are provided. In FIG. 3, the internal dimensions of plunger, lifter seat, or push rod cup are modified to place the plunger on the order of 0.050 inch above its seat 16 when the lifter is in its assembled state. This requires less adjustment and therefore the rocker arm does not tilt back as far, eliminating the geometry problem.

In FIG. 4, a conventionally dimensioned lifter can be used with a spacer or spacers between the plunger and push rod cup to extend the plunger 14 down further in the lifter, eliminating the geometry problem. In FIG. 5, a conventionally dimensioned lifter can be used with a spacer 22 or spacers between the plunger 14 and lifter seat 16 to accomplish the same purpose. This allows for the proper positioning of the plunger without costly modifications to the lifter. Currently spacers below the plunger are being used by some within the industry with conventional non-fast bleed hydraulic lifters to limit plunger travel in the event of inadvertent bleed down at very high rpm. This is an unusual occurrence and has nothing to do with fast bleed lifters. While longer push rods 26 can be used instead of spacers to accomplish the same thing, the spacers eliminate the added cost to the customer of custom made push rods.

ALTERNATIVE EMBODIMENTS

While the drawings show a flat tappet lifter design, there are other lifter designs which also apply to our idea. Chief among them is the roller lifter design, where a roller is incorporated into the bottom of the lifter and rides directly on the camshaft for reduced friction. Its internal components are virtually identical to the flat tappet. Nearly all modern engines today that utilize push rods are equipped with roller lifters. Other designs are used with overhead cams that have no pushrods. They are primarily of two types. The lash adjuster type acts as a pivot point for the rocker arm and has internals with a plunger and seat as does the flat tappet. The hydraulic bucket also has a hydraulic mechanism with a piston, but it is positioned directly between the camshaft and valve. No matter what combination of hydraulics and linkage is used in the valve train, all designs can be made to conform to this invention.

Advantages

The adjustable fast bleed variable duration hydraulic lifter presented herein has many advantages over the prior art including but not limited to the following:

(a) Since the bleed down amount is precisely limited by the adjustment of the valve train and not by the amount of bleed rate as is utilized with other variable duration lifters and the standard adjustment, a faster bleed lifter can be used to maximize low end torque, engine vacuum, idle quality, fuel economy, improved exhaust emissions, and high rpm performance. The faster bleed rate will allow the engine to rev higher before encountering lifter float. The maximum amount of bleed down can be used without causing trauma to the valve train.

(b) The adjustment can be customized to meet specific performance needs by varying the plunger travel of the lifters, or by having differing amounts of plunger travel for the intake valves as opposed to the exhaust valves.

(c) When using a stock cam or a milder performance camshaft, a slower bleed rate lifter can be used so that the lifter restores the lift and duration at a lower point on the rpm scale. The adjustment will limit the plunger travel so as not to go beyond what would be detrimental to the valve train regardless of engine temperature, oil viscosity, valve spring pressure, etc. In such cases, the plunger may or may not bottom out against its seat.

(d) Valve bounce, which is particularly common in roller lifters when valve separation occurs with a solid lifter camshaft and solid lifters, can be significantly reduced if the solid lifter is replaced with a fast bleed variable duration hydraulic lifter and the special adjustment outlined in this invention.

(e) Since conventional camshafts are used as part of our invention, a much wider selection of performance cams are available to the user than would be possible with specially modified cams required in the prior art.

CONCLUSION, RAMIFICATIONS, AND SCOPE

Accordingly, the reader can see that the advantages of our adjustable fast bleed variable duration lifter far exceed what is currently possible with existing variable duration lifters and the conventional adjustment.

Conventional variable duration lifters with the conventional adjustment do not allow for maximum bleed down and hence maximum reductions in lift and duration of high performance camshafts. Our invention, on the other hand, provides for maximum bleed down and maximum control because the bleed down amount is precisely set by positioning the plunger very near the bottom of the lifter seat. This precision adjustment permits the use of faster bleed lifters which increases the low-end torque, idle quality, fuel economy and reduced emissions that are only made possible with our invention. It can also nearly double the vacuum gains of other variable duration lifters with no adverse affects to the valve train do to excessive bleed down.

This invention is not just a theory. Our design works and is currently being sold to a few customers with excellent results across the country. Hot Rod Magazine recently tested our product on a dynamometer and it significantly increased low end torque and engine vacuum on a modern engine. The results will be published in Hot Rod Magazine in an upcoming article to be released in June or July of this year.

Just how a variable duration lifter bleeds down, or precisely how much it bleeds is incidental to this invention, and therefore we have not described the various designs or bleed rates in any detail. Some lifters bleed by utilizing a groove up the side of the plunger body that connects with the oil chamber, while others use a more loosely fit plunger to attain the desired bleed down rate. This invention pertains to any and all variable duration lifters regardless of type, bleed down rate, or design.

The connecting linkage also varies from one engine to another depending on the design of the lifter in question. This invention assumes that any linkage arrangement that can position the plunger to within 0.050 inch or less of its seat will fall within the scope of this invention.

Although the description above contains a number of specifications, these should not be construed as limiting the scope of the invention but as merely providing illustrations of some of the presently preferred embodiments of this invention. Thus the scope of the invention should be determined by the appended claims and their legal equivalents, rather than by the examples given.

We claim:

1. A method to limit the bleed down of a variable duration hydraulic lifter by utilizing the components of an engine valve train, comprising:

(a) providing an engine valve train which includes a valve, (b) providing a cam of a camshaft for use with a non-variable duration lifter, (c) providing a bleed down variable duration hydraulic lifter which is modified to reduce the plunger travel of said lifter riding on or acted upon by said cam, the components of said lifter consisting of an outer cylindrical body and an inner plunger axially slidable within said outer cylindrical body and defining an oil chamber therebetween, said outer cylindrical body defining a seat which defines or supports a lower most position for said plunger, wherein at least one component of said bleed down variable duration hydraulic lifter is modified in dimensional size or positioned so as to reduce the amount of axial movement of said plunger within said outer cylindrical body, (d) providing connecting linkage between said bleed down variable duration hydraulic lifter and said valve, said valve train comprising being of effective dimension such that when said valve is statically seated, said inner plunger is limited to no more than approximately 0.050 inch axial movement within said outer cylindrical body, whereby the bleed down of a variable duration hydraulic lifter is limited by the axial movement of said plunger within said outer cylindrical body when combined with a cam of a camshaft for use with a non-variable duration lifter, and whereby proper rocker arm geometry is maintained without the need for modifications to the valve train connecting linkage.

2. The method of claim 1 wherein at least at low engine operating speeds below on the order of 1000 rpm, said plunger bottoms out at said lower most position prior to valve seating.

3. The method of claim 1 wherein an additional component consisting of at least one spacer is provided above said plunger of said bleed down variable duration hydraulic lifter.

4. The method of claim 1 wherein an additional component consisting of at least one spacer is provided between said plunger and said outer cylindrical body of said bleed down variable duration hydraulic lifter.

5. The method of claim 1 wherein an additional component consisting of a pushrod cup is provided above said plunger of said bleed down variable duration hydraulic lifter.

6. The method of claim 3 wherein an additional component consisting of a pushrod cup is provided above said spacer.

7. The method of claim 6 wherein at least one spacer is adapted to restrict a flow of oil.

* * * * *